US005873497A

United States Patent [19]

Broadus

[11] Patent Number: 5,873,497

[45] Date of Patent: Feb. 23, 1999

[54] SPRAY TUBE RETENTION DEVICE FOR PRESSURIZED DISPENSERS

[76] Inventor: Brad R. Broadus, 22003 Blackwell Farm Rd., Saucier, Miss. 39574

[21] Appl. No.: 871,643

[22] Filed: Jun. 9, 1997

[51] Int. Cl.[6] ..... B67D 5/32

[52] U.S. Cl. ..... 222/153.09; 222/402.1; 222/573; 239/337; 239/600

[58] Field of Search ..... 222/153.09, 402.1, 222/566, 573; 239/337, 600

[56] References Cited

U.S. PATENT DOCUMENTS

| | | | |
|---|---|---|---|
| 2,908,446 | 10/1959 | Strouse | 222/566 |
| 3,148,806 | 9/1964 | Meshberg | 239/337 |
| 4,819,838 | 4/1989 | Hart, Jr. | 239/337 |
| 4,991,750 | 2/1991 | Moral | 222/402.24 |
| 5,060,823 | 10/1991 | Perlman | 222/402.1 |
| 5,297,704 | 3/1994 | Stollmeyer | 222/567 |
| 5,423,458 | 6/1995 | Tourigny | 222/192 |
| 5,529,226 | 6/1996 | Alberth, Jr. | 222/402.1 |

*Primary Examiner*—Joseph A. Kaufman
*Attorney, Agent, or Firm*—Dowell & Dowell, P.C.

[57] ABSTRACT

A spray tube for a pressurized dispenser is secured within an orifice of a spray nozzle using a coiled retention member which is selectively rotated about the spray nozzle to engage the spray tube between spaced turns of the coiled member.

11 Claims, 1 Drawing Sheet

SPRAY TUBE RETENTION DEVICE FOR PRESSURIZED DISPENSERS

BACKGROUND OF THE INVENTION

1. Field of the Invention

This invention is generally directed to pressurized dispensers of the type which include a spray nozzle which is normally depressed to activate a valve to allow contents to be dispensed under pressure from a container and wherein an extension spray tube is secured within the orifice of the spray nozzle to ensure that the spray tube does not become dislodged or re-oriented when the dispenser is in use. More particularly, the present invention is directed to a retention member in the form of a resilient coil having a plurality of turns wherein the coil may be rotated about the spray nozzle to selectively engage a spray tube and thereby retain the spray tube within the orifice of the nozzle during the use of the pressurized dispenser.

2. History of the Related Art

Extension spray tubes have commonly been used with dispensers in order to allow the contents of the dispenser to be directed to a particular point of application. Extension spray tubes are most conventionally used with pressurized spray containers which include a valve assembly having a valve nozzle with a spray orifice. Such valve nozzles are operable by depressing the nozzles relative to the container to thereby release the contents of the container under pressure.

Spray tubes are conventionally designed to frictionally engaged within orifices of spray nozzles and once the nozzles are open to the pressurized fluids within containers, such extension tubes are frequently dislodged from within the orifices of the spray nozzles. Even if the spray tubes are not initially dislodged by the fluid contents under pressure, the spray tubes can become misaligned during use thus allowing the pressurized contents of dispensers to be improperly discharged.

In an effort to overcome the accidental displacement of extension spray tubes relative to spray nozzles for use with pressurized dispensers, U.S. Pat. No. 4,991,750 to Moral disclosed a modified spray nozzle having a stepped orifice allowing increasing frictional engagement of a spray tube within the orifice. Unfortunately, this type of structure does not completely eliminate the possibility of the spray tube becoming dislodged either by the pressurized contents of the dispenser or by accidental movement of the spray tube during use.

Another type of device for securing a spray tube within an orifice of a spray nozzle for pressurized dispensers is disclosed in U.S. Pat. No. 5,297,704 to Stollmeyer. This device discloses a strap-like member having a plurality of spaced openings therein. The spray tube is extended through a pair of spaced openings in the strap member and an end of the strap member is engaged over a back portion of the nozzle remote from the orifice. With this type of arrangement, the spray nozzle is retained somewhat more securely, however, still can become accidentally dislodged if the outer end of the spray tube is accidentally abutted against an object. Further, the amount of retaining force provided by the strap member is somewhat limited as the spray tube can be axially shifted relative to the openings formed in the strap member under the force of the contents of the fluid dispenser during use.

In view of the foregoing, there remains a need to provide retention devices for use with spray tubes for nozzles of pressurized dispensing containers which can be easily utilized to positively secure spray tubes in a securely mounted position relative to the orifice of spray nozzles during use.

SUMMARY OF THE INVENTION

The present invention is directed to a coiled retention member for positively securing a spray tube within the orifice of a spray nozzle associated with a pressurized fluid dispenser. The coiled retention member includes a plurality of turns which are integrally formed with one another and which, in a preferred embodiment, may be spaced relative to one another at a distance which is slightly less than the diameter of the spray tube. The coiled retention member preferably includes a free end which is angled away from an adjacent turn of the coil so as to provide an outwardly beveled opening between adjacent turns of the coil to facilitate the positioning of the coiled retention member relative to a spray nozzle.

The coiled retention member is designed to be of a diameter which is substantially equal to or slightly less than the diameter of the spray nozzle so that the coiled retention member may be rotated about the outside of the spray nozzle. As the coiled retention member is rotated relative to the spray nozzle, the spray tube which has been previously positioned within the orifice of the nozzle will pass between the free end of the coiled retention member and the adjacent turn thereof. By continuing to rotate the coiled retention member relative to the nozzle, the spray tube will be frictionally clamped between adjacent turns of the coiled retention member.

In use, the coiled retention member may be placed over the spray nozzle of the dispenser when the spray nozzle has been removed from the dispensing valve associated with the dispenser or may be positioned with the spray nozzle mounted to the dispenser.

Also, in the preferred embodiment, the coiled retention member is formed of a resilient material such that the spacing between the turns of the coil may be varied depending upon the size of the spray tube being secured to the spray nozzle.

It is the primary object of the present invention to provide a low cost and effective retention member for securing a spray tube within an orifice of a spray nozzle of a pressurized fluid dispenser so that the spray tube is retained properly seated within the orifice during times when the contents of the container are being dispensed.

It is yet another object of the present invention to provide a retention member which may be utilized with various sizes of spray tubes for use with dispensing nozzles of pressurized fluid dispensers wherein the retention device may be mounted at all times upon the dispensing nozzle and may be easily manipulated into an engaging position with a spray tube after the tube is inserted within the orifice of the nozzle.

It is yet another object of the present invention to provide a retention member for use in securing a spray tube within the orifice of a spray nozzle for pressurized fluid dispensers wherein the retention member clampingly engages the spray tube and retains it in position during use even if the outer end of the spray tube becomes accidentally engaged.

DESCRIPTION OF THE PREFERRED EMBODIMENT

Figure 1:
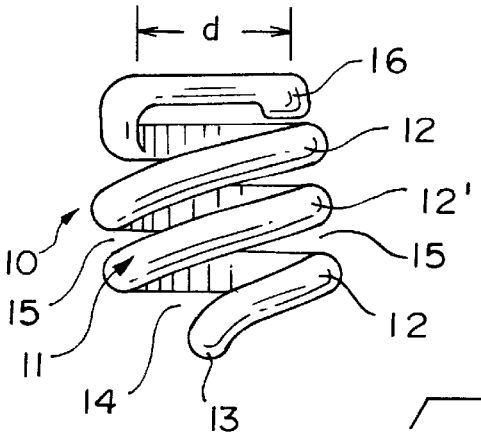
FIG. 1 is a front plan view of the coiled retention member of the present invention.
Figure 2:
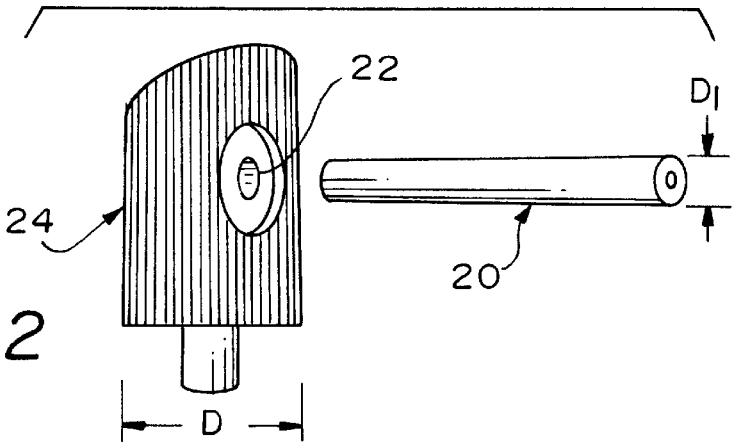
FIG. 2 is a partial assembly view showing a spray nozzle for a pressurized fluid dispenser showing a spray tube being aligned relative to the discharge orifice of the spray nozzle.

With continued reference to the drawings, the spray tube retention device 10 of the present invention is shown in FIG. 1 as being in the form of a coil 11 having a plurality of turns 12 which are continuously formed in a spiral manner from a free end 13 to an opposite end 16. The free end 13 of the coil is shown as being angled downwardly or outwardly relative to the next adjacent turn 12' of the coil to thereby provide a flared opening 14 between the adjacent turns.

Figure 3:
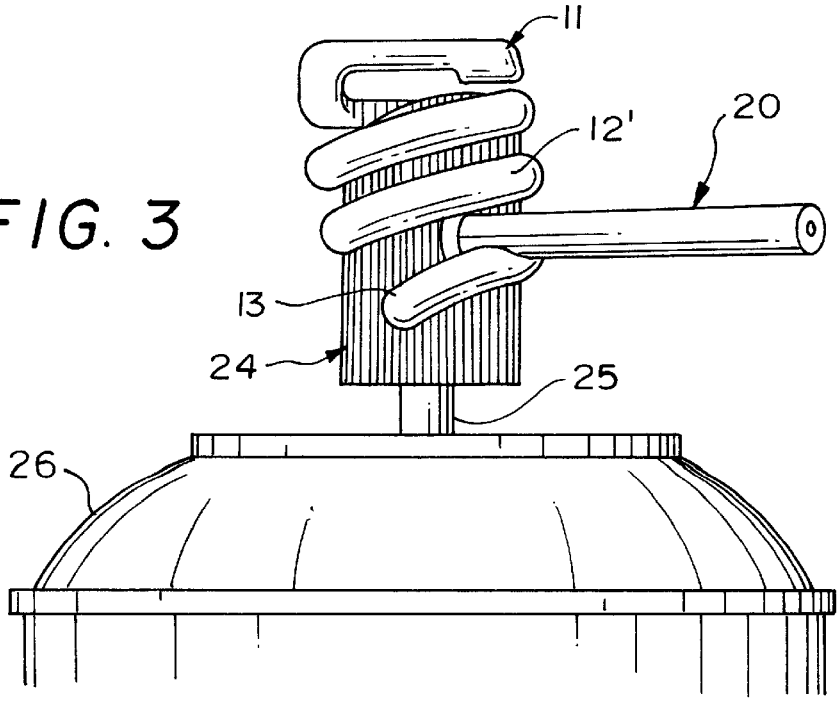
FIG. 3 is a perspective illustrational view of a pressurized fluid spray container having a discharge nozzle mounted thereto with the spray tube mounted within the orifice thereof and with the retention member of FIG. 1 shown turned to effect a clamping engagement with the spray tube.

In the preferred embodiment, coil 11 is preferably formed of a resilient metallic or plastic material so that the spacing 15 between the adjacent turns of the coil may be varied to allow the coil to be utilized to secure spray tubes 20 having varying diameters $D_1$ within an orifice 22 associated with a spray nozzle 24 mounted to a dispensing valve stem 25 of a pressurized fluid dispenser 26. The coil is defined by an inner diameter d which is generally equal to or slightly less than the diameter D of the spray nozzle 24 so that the coil, when mounted over the nozzle, as shown in FIG. 3, is frictionally secured thereto. In this respect, the coiled retention member 10 of the present invention may be supplied by a manufacturer mounted directly to the spray nozzle and with retention member being easily positioned relative to the spray orifice, such as not to interfere with the normal use of the spray orifice when the spray tube 20 is not in use, but which allows a simple rotation of the retention member relative to the spray nozzle, as shown by the arrow in FIG. 3, to secure the spray tube within the orifice 22.

Although the turns 12 of the coil may be formed abutting one another, in the preferred embodiment, a gap or spring 15 is provided therebetween. The spiral gap which extends between each of the turns of the coil is preferably of a dimension which is slightly less than the diameter $D_1$ of the spray tube.

In use, the retention member 10 is placed over the upper portion of the spray nozzle 24 such that the opening 14 between the free end 13 and the adjacent turn 12' of the coil are positioned in offset relationship with respect to the spray orifice 22 of the nozzle. Thereafter, the spray tube is inserted within the orifice 22 after which the coil is rotated approximately one quarter of a turn so that the spray tube is engaged between two turns of the coil after passing through the opening 14 into the spiral gap 15 between the turns. In this position, the adjacent turns of the coil will securely clampingly engage the spray tube in seated relationship with respect to the orifice 22.

In some instances, to facilitate mounting of the spray tube and its locking to the spray nozzle, the spray nozzle may be removed from the valve stem 25 associated with the fluid dispenser 26 and thereafter the spray tube secured thereto. After the spray tube has been locked into position utilizing the retention member 10, the spray nozzle may be reseated on the valve stem 25 and the spray tube oriented for proper use.

It should be noted that the number of turns 12 associated with the coil may vary depending upon the anticipated use of the retention member.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. In a pressurized fluid dispenser having a spray nozzle with a dispensing orifice and a spray tube removably seated within the orifice, the improvement comprising, a retention member for securing the spray tube within the orifice, said retention member including a coil having a plurality of continuous turns and a free end, said coil being of a size to be cooperatively seated about the nozzle with the spray tube being clampingly engaged between adjacent turns of said coil.

2. The pressurized dispenser of claim 1 wherein said free end of said coil is angled outwardly away from an adjacent turn of said coil.

3. The pressurized dispenser of claim 2 wherein said coil is formed of a resilient material.

4. The pressurized dispenser of claim 3 wherein said turns of said coil are spaced from one another by a spiral gap that is of a dimension which is less than a diameter of the spray tube.

5. The pressurized dispenser of claim 4 wherein said coil has an inner diameter which is generally equal to a diameter of the spray nozzle.

6. The pressurized dispenser of claim 1 wherein said coil is formed of a resilient material.

7. The pressurized dispenser of claim 1 wherein said turns of said coil are spaced from one another by a spiral gap that is of a dimension which is less than a diameter of the spray tube.

8. The pressurized dispenser of claim 1 wherein said coil has an inner diameter which is generally equal to a diameter of the spray nozzle.

9. A combination pressurized fluid dispenser having a spray nozzle associated therewith wherein the spray nozzle includes a spray orifice in which a spray tube is selectively mounted and a retention member for retaining the spray tube within the spray orifice of the dispensing nozzle, the retention member being a coil including a plurality of turns, said coil having an inner diameter of a size to frictionally engage and be seated about said spray nozzle so as to be selectively rotatable with respect thereto and including a free end defining an opening into a spiral gap defined by said turns of said coil whereby said coil may be rotated relative to said dispensing nozzle to thereby engage said spray tube between said turns of said coil to secure said spray tube within the spray orifice of the dispensing nozzle.

10. The combination of claim 9 wherein said coil is formed of a resilient material.

11. The combination of claim 9 when said spiral gap is of a dimension which is less than a diameter of said spray tube.

* * * * *